United States Patent [19]

Miller

[11] Patent Number: 4,624,717

[45] Date of Patent: Nov. 25, 1986

[54] ALUMINUM ALLOY HEAT TREATMENT

[75] Inventor: William S. Miller, Gerrards Cross, England

[73] Assignee: Alcan International Limited, Montreal, Canada

[21] Appl. No.: 595,447

[22] Filed: Mar. 30, 1984

[30] Foreign Application Priority Data

Mar. 31, 1983 [GB] United Kingdom ..... 8308907
Mar. 31, 1983 [GB] United Kingdom ..... 8308908

[51] Int. Cl.[4] ..... C22F 1/04

[52] U.S. Cl. ..... 148/12.7 A; 148/415; 148/416; 148/417

[58] Field of Search ..... 148/11.5 A, 2, 12.7 A, 148/415–418, 437–440

[56] References Cited

U.S. PATENT DOCUMENTS 3,984,260 10/1976 Watts et al. ..... 148/439

OTHER PUBLICATIONS

"Superplasticity in High Strength Aluminum Alloys", C. Howard Hamilton, Cliff C. Bampton and Neil E. Patron, Rockwell International Science Center, pp. 173–189.

*Primary Examiner*—R. Dean
*Attorney, Agent, or Firm*—Browdy and Neimark

[57] ABSTRACT

A method of producing sheet or strip from a rolling ingot of an aluminum alloy which contains lithium and constituents selected from the following groups 1 and 2:

Group 1—deliberately added magnesium, copper and zinc;

Group 2—Zirconium manganese, chromium, titanium, iron and nickel;

comprising hot rolling the rolling ingot in one or more stages to produce a hot blank; holding the hot blank at a temperature and for a time which causes substantially all of the lithium and substantially all of any of the Group 1 constituents present to be in solid solution; positively cooling the hot blank; subjecting the cooled blank to a further heat treatment to re-precipitate those age hardening phases in solid solution, continuing the heat treatment to produce a coarse overaged morphology and thereafter cold rolling the blank to form a sheet or strip which at any position therein and in any direction therefrom has properties of elongation that vary from those in the rolling direction by no more than 2.0%.

20 Claims, 2 Drawing Figures

ALUMINUM ALLOY HEAT TREATMENT

Figure 1:
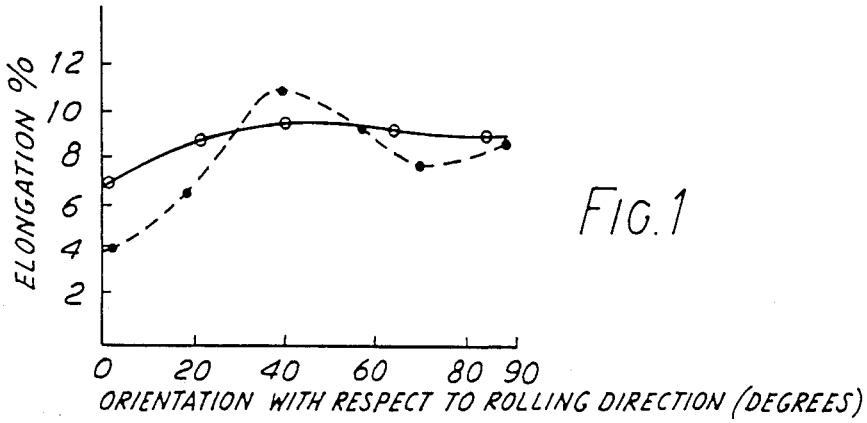

This invention relates to the heat treatment of aluminium/lithium alloys which are suitable for aerospace air frame construction.

Such alloys are attractive in providing significant weight reduction over other aluminum alloys and it is known that they can present high strength and stiffness and have good corrosion resisting properties.

In the past most Al/Li alloys have been based upon the Al/Li/Mg system including, for example, Li 2.1% and Mg 5.5%, or on using a relatively high level of lithium addition to conventional aerospace alloys via powder metallurgy, for example, an addition of 3% or more Li to alloy 2024. More recently alloys containing Li, 3% or more; Cu, about 1.5%; Mg about 2% and Zr about 0.18% have been proposed. Such alloys have improved fracture toughness and also facilitate hot and cold working.

Our copending application No. 8308908 filed on the Mar. 31, 1983 discloses an aluminium base alloy having a composition within the following ranges in weight percent:

Lithium: 2.3 to 2.9
Magnesium: 0.5 to 1.0
Copper: 1.6 to 2.4
Zirconium: 0.05 to 0.25
Titanium: 0 to 0.5
Manganese: 0 to 0.5
Nickel: 0 to 0.5
Chromium: 0 to 0.5
Zinc: 0 to 2.0
Aluminium: Remainder (apart from incidental impurities)

It has long been recognised that mechanical deformation, by processes such as hot and cold rolling, can lead to the development of crystallographic preferred orientation in metallic materials in sheet or strip form. This manifests itself in several ways, most of which are considerably detrimental to the properties of the product. In particular, anisotropy of mechanical properties can result so that the strength and ductility of the wrought, or wrought and annealed, product can vary appreciably according to the direction within the plane of the sheet or strip in which the properties are measured. These effects are common in the simple aluminium based alloys such as those of the 1000, 3000 or 5000 series (as designated by the Aluminium Association) but are not encountered to a significant extent in the aluminium alloys of the 2000 and 7000 series that are normally used in air-craft construction. However, experimentation in the development of aluminium-lithium based alloys has revealed that considerable problems of anisotropy of properties results when the alloys are processed by routes similar to those employed for 2000 and 7000 series alloys. Additionally, the techniques of control of anisotropy conventionally applied to the 1000, 3000 and 5000 series alloys, such as control of the Fe:Si ratio, cannot be applied to the aluminium-lithium based alloys because iron levels are, necessarily, kept low. It has, therefore, been necessary to develop special thermal and mechanical processing techniques to control anisotropy of mechanical properties, and particularly elongation, within acceptable bounds in these alloys.

According to the present invention there is provided a method of producing sheet or strip from a rolling ingot of an aluminium alloy which contains lithium and constituents selected from the following groups 1 and 2:

Group 1 deliberately added magnesium, copper and zinc;

Group 2 Zirconium, manganese, chromium, titanium, iron and nickel;

comprising hot rolling the rolling ingot in one or more stages to produce a hot blank; holding the hot blank at a temperature and for a time which causes substantially all of the lithium and substantially all of any of the Group 1 constituents present to be in solid solution; positively cooling the hot blank; subjecting the cooled blank to a further heat treatment to reprecipitate those age hardening phases in solid solution, continuing the heat treatment to produce a coarse overaged morphology and thereafter cold rolling the blank to form a sheet or strip which at any position therein and in any direction therefrom has properties of elongation that vary from those in the rolling direction by no more than 2.0%. Preferably the sheet or strip at any position therein and in any direction therefrom has tensile properties that vary from those in the rolling direction by no more than 25 MPa (0.2% proof stress and tensile stress). The initial hot blank heating temperature may be between 480° C. and 540° C. and the time may vary between 20 and 120 minutes depending upon the thickness of the blank and the blank's prior thermal history. If the hot blank falls to a temperature below 480° C. the blank may be reheated to solutionise those age hardening phases of any Group 1 constituents.

Preferably the hot blank has a thickness of 12.5 mm to 3 mm. The sheet or strip may have a thickness up to 10 mm and preferably has a thickness of no more than 5 mm. Advantageously the hot blank is positively cooled by air blast cooling.

The positive cooling may terminate at the temperature of the further heat treatment so that the positive cooling and further heat treatment steps are merged together. The further heat treatment will generally be at a temperature between 300° C. and 400° C. for a period of 8 to 16 hours.

Figure 2:
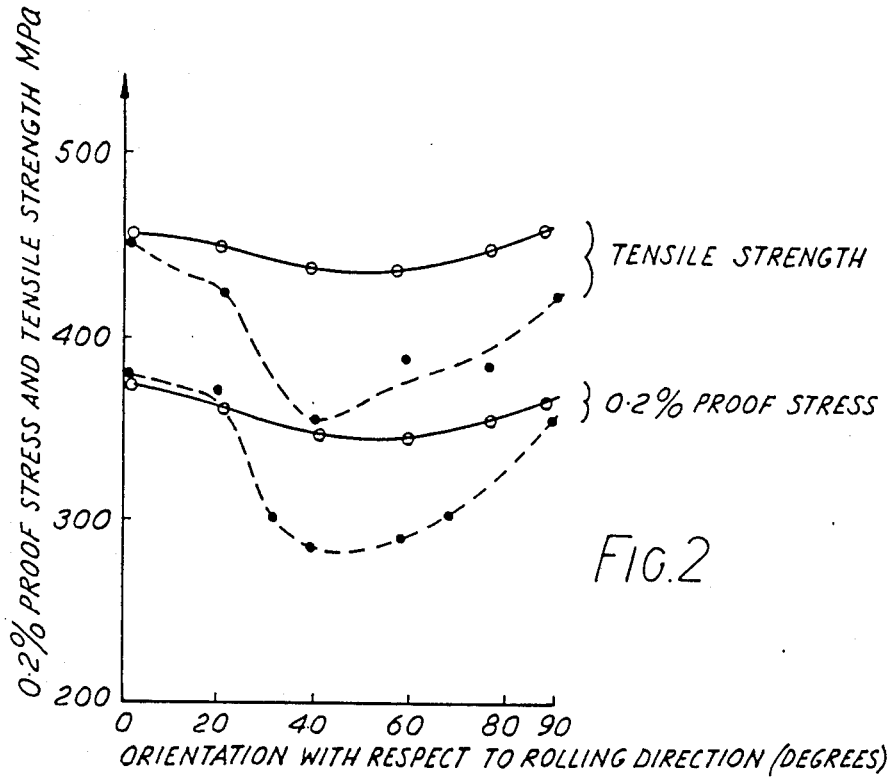

The invention will now be further described in relation to the following examples, and with reference to the accompanying drawing in which:

FIGS. 1 and 2 are graphs respectively showing variations in elongation and tensile strength properties of 1.6 mm gauge sheet plotted against various test directions relative to the rolling direction.

In the first example, a 5 mm thick blank was hot rolled from a 300 kg, 508 mm×178 mm, semi-continuously DC cast ingot of the following composition:

Lithium: 2.5
Magnesium: 0.6
Copper: 1.2
Zirconium: 0.12
Titanium: 0.01
Aluminium: Remainder (including incidental impurities)

The hot blank was subjected to a variety of heat treatment processes, cold rolled to 2 mm gauge sheet (60% cold work). The tensile properties of the sheet in the longitudinal (parallel to the rolling direction) and transverse (across the width of the sheet) after solution treating (15 mins. at 520° C., cold water quenched) and ageing (16 h at 170° C.) are given in Table 1. The results clearly demonstrate that only in the case of hot rolled blank heat treated in accordance to the present invention prior to cold rolling (heat treatment identity E) is the sheet product isotropic with regard to elongation in the longitudinal and transverse directions.

The benefits of the present invention in controlling anisotropy can be further illustrated by consideration of FIGS. 1 and 2. Material processed according to route A (dotted curve in FIGS. 1 and 2) shows a significant reduction in strength and increased ductility when tested at directions 30° to 60° (inclusive) to the rolling direction. Similar data was obtained from material processed using heat treatments B, C and D. In contrast, material processed according to the present invention (full curve in FIGS. 1 and 2) shows only a marginal variation in tensile properties with test direction as described above.

Furthermore, during the cold rolling of hot blank heat treated according to the present invention, an approximate 40% increase in throughput was observed compared to material heat treated using any of the conventional routes detailed in Table 2. Specifically, in two separate trials increased throughputs of 37% and 44% respectively were obtained. In the second example, a 6.25 mm thick hot blank was hot rolled from a 300 kg, 508 mm×178 mm direct chill cast ingot of the following composition:

Lithium: 2.8%
Magnesium: 0.9%
Copper: 1.8%
Zirconium: 0.12%
Titanium: 0.01%
Aluminium: Remainder (including incidental impurities)

This composition corresponds with that disclosed in one of the examples of our copending Application No. 8308908.

The hot blank was subjected to the heat treatments given in Table 2 and cold rolled. The ease of cold rolling of the hot blank was determined by examination of degree of edge cracking. Rolling being terminated when the edge cracks had penetrated to a depth >15% of the sheet width. Only in the case of material heat treated according to the present invention could satisfactory cold reductions be obtained. The sheet material satisfactorily processed according to the present invention was also substantially free of anisotropy. Reference is made to Table 1 in our above mentioned copending application No. 8308908.

It should be noted that certain aspects of the present invention have been described previously as a means of achieving very fine grain sizes in "standard" aircraft alloys such as 7075 and 7475 thereby enabling such alloys to be superplastically deformed. Such work, notably by Rockwell International is referred to in C. H. Hamilton, C. C. Bampton and N. E. Paton "Superplasticity in High Strength Aluminium Alloys", pp 173–189 in *Superplastic Forming of Structural Alloys* AIME, New York, N.Y. 1982 (ISBN 0-89520-389-8). However the heat treatment schedules of the present invention do not cause recrystallisation of the Al/Li base alloys.

TABLE 1

The influence of blank heat treatment on the anisotropy of tensile properties of cold rolled sheet As per Example 1.

| Heat treatment identity | Blank heat treatment at 5 mm gauge | T6, Tensile properties of 2.0 mm gauge cold rolled sheet: Longitudinal direction 0.2% PS MPa | TS MPa | El % | Transverse direction 0.2% PS MPa | TS MPa | El % |
|---|---|---|---|---|---|---|---|
| | None | | | | | | |
| A | Generally used for Al-alloys | 353 | 422 | 3.0 | 348 | 439 | 11.0 |
| B | Anneal 3h @ 370° C. | 356 | 434 | 4.0 | 369 | 446 | 8.0 |
| C | Solution treated 1 hour at 520° C. Air cool | 361 | 443 | 3.0 | 363 | 448 | 8.0 |
| D | Solution treated 1 hour at 520° C. - Air cool Annealed 16 hour at 200° C. | 364 | 445 | 3.0 | 333 | 427 | 8.5 |
| E | Solution treated 1 hour at 520° C. - Air cool Annealed 12 hours at 370° C. (As per present invention) | 350 | 452 | 6.0 | 369 | 456 | 7.0 |

TABLE 2

Cold rolling characteristic of Example 2 alloy following various blank heat treatments prior to cold rolling

| Blank heat treatment | Original gauge (mm) | Gauge on termination of rolling[1] (mm) | Percentage cold work sustained prior to termination of rolling |
|---|---|---|---|
| None | 6.25 | 5.0 | 20 |
| Annealed 3 hours at 370° C. | 6.25 | 5.3 | 15 |
| Solution treated 1 hour at 540° C. Air cooled | 6.25 | 5.5 | 12 |
| Solution treated 1 hour at 540° C. Air cooled. Annealed 12 hours at 370° C. (as per present invention) | 6.25 | 1.8 | 72 |

[1]Termination of cold rolling when edge cracking was to a depth >15% of the sheet width

I claim:

1. A method of producing sheet or strip from a rolling ingot of an aluminium alloy which contains lithium and constituents selected from the following groups 1 and 2:

Group 1—deliberately added magnesium, copper and zinc;

Group 2—Zirconium, manganese, chromium, titanium, iron and nickel;

comprising hot rolling the rolling ingot in one or more stages to produce a hot blank; holding the hot blank at a temperature and for a time which causes substantially all of the lithium and substantially all of any of the Group 1 constituents present to be in solid solution; positively cooling the hot blank; subjecting the cooled blank to a further heat treatment at a temperature sufficient to reprecipitate those age hardening phases in solid solution, continuing the heat treatment to produce a coarse overaged morphology, and thereafter cold rolling the blank to form a sheet or strip which at any position therein and in any direction therefrom has properties of elongation that vary from those in the rolling direction by no more than 2.0%.

2. A method according to claim 1, in which the sheet or strip at any position therein and in any direction therefrom has properties of elongation that vary from those in the rolling direction by no more than 25 MPa (0.2% proof stress and tensile stress).

3. A method according to claim 1 in which the initial hot blank holding temperature is between 480° C. and 540° C. and the time varies between 20 and 120 minutes depending upon the thickness of the blank and the blank's prior thermal history.

4. A method according to claim 1 in which the hot blank is positively cooled by air blast cooling.

5. A method according to claim 1 in which if the hot blank falls to a temperature below 480° C. the blank is reheated to solutionise those age hardening phases of any Group 1 constituents.

6. A method according to claim 1 in which the hot blank has a thickness of 12.5 mm to 3 mm.

7. A method according to claim 1 in which the sheet or strip has a thickness up to 10 mm.

8. A method according to claim 1 in which the positive cooling terminates at the temperature of the further heat treatment so that the positive cooling and further heat treatment steps are merged together.

9. A method according to claim 8 in which the further heat treatment is at a temperature between 300° C. and 400° C. for a period of 8 to 16 hours.

10. A method according to claim 2 in which the initial hot blank holding temperature is between 480° C. and 540° C. and the time varies between 20 and 120 minutes depending upon the thickness of the blank and the blank's prior thermal history.

11. A method according to claim 10 in which the hot blank is positively cooled by air blast cooling.

12. A method according to claim 2 in which if the hot blank falls to a temperature below 480° C. the blank is reheated to solutionize those age hardening phases of any Group 1 constituents.

13. A method according to claim 3 in which if the hot blank falls to a temperature below 480° C. the blank is reheated to solutionize those age hardening phases of any Group 1 constituents.

14. A method according to claim 4 in which if the hot blank falls to a temperature below 480° C. the blank is reheated to solutionize those age hardening phases of any Group 1.

15. A method according to claim 3 in which the hot blank has a thickness of 12.5 mm to 3 mm.

16. A method according to claim 14 in which the hot blank has a thickness of 12.5 mm to 3 mm.

17. A method according to claim 3 in which the sheet or strip has a thickness no more than 5 mm.

18. A method according to claim 15 in which the sheet or strip has a thickness no more than 5 mm.

19. A method according to claim 3 in which the positive cooling terminates at the temperature of the further heat treatment so that the positive cooling and further heat treatment steps are merged together.

20. A method according to claim 18 in which the positive cooling terminates at the temperature of the further heat treatment so that the positive cooling and further heat treatment steps are merged together.

* * * * *